US005145447A

United States Patent [19]

Goldfarb

[11] Patent Number: 5,145,447

[45] Date of Patent: Sep. 8, 1992

[54] MULTIPLE CHOICE VERBAL SOUND TOY

[76] Inventor: Adolph E. Goldfarb, 1432 S. Eastwind Cir., Westlake Village, Calif. 91361

[21] Appl. No.: 652,934

[22] Filed: Feb. 7, 1991

[51] Int. Cl.[5] ..... A63H 3/52; A63H 33/30; A63H 5/00; A63H 29/22

[52] U.S. Cl. ..... 446/408; 446/143; 446/397; 446/484; 369/31; 369/63; 434/322; 84/601

[58] Field of Search ..... 446/175, 141, 142, 143, 446/268, 299, 302, 303, 304, 397, 404, 408, 484, 485; 369/31, 63; 365/45; 434/322, 333; 84/600, 601, 603, 604, 622, 626

[56] References Cited

U.S. PATENT DOCUMENTS

| | | | |
|---|---|---|---|
| 3,276,144 | 10/1966 | Feldman | 369/63 X |
| 4,321,768 | 3/1982 | Engelhardt | 446/397 X |
| 4,508,511 | 4/1985 | McQueen | 446/485 X |
| 4,648,086 | 3/1987 | Koike | 369/63 X |
| 4,699,039 | 10/1987 | Oguri et al. | 84/622 |
| 4,799,171 | 1/1989 | Cummings | 446/175 X |
| 4,809,246 | 2/1989 | Jeng | 369/31 X |
| 4,840,602 | 6/1989 | Rose | 446/175 |
| 4,923,428 | 5/1990 | Curran | 496/175 |
| 4,939,974 | 7/1990 | Ishida et al. | 84/601 X |
| 5,074,182 | 12/1991 | Capps et al. | 84/600 X |

FOREIGN PATENT DOCUMENTS

| | | | |
|---|---|---|---|
| 2222093 | 2/1990 | United Kingdom | 446/302 |

*Primary Examiner*—Mickey Yu
*Assistant Examiner*—D. Neal Muir
*Attorney, Agent, or Firm*—Ashen & Lippman

[57] ABSTRACT

A multiple-choice verbal sound toy uses a microprocessor to produce one song or poem that has at least one space or slot for introducing a supplementary verbal sound segment to complete the song or poem. The child user may be given a plurality of different choices of segments for completing the song or poem. For example, the microprocessor may play a song such as "Old McDonald Had a Farm", and a child user may select—as by pushing one of several keys associated with pictures of different farm animals—the verbal sounds made by that particular animal, to be inserted into each verse of the song. The song or poem may have a series of slots or spaces and there may be a plurality of sets of verbal sounds to be inserted with the individual sounds in each set being a plurality of the same sounds or a variety of different but related sounds. Sounds may be inserted in successive verses cumulatively, in the order (or reverse order) in which they are first introduced.

14 Claims, 3 Drawing Sheets

MULTIPLE CHOICE VERBAL SOUND TOY

BACKGROUND

1. Field of the Invention

This invention relates generally to computerized sound-making toys for small children; and more particularly to such toys that use voice-synthesis technology to sing songs or recite poems interactively with the children.

2. Prior Art

Children love to interact or cooperate with their toys. In the simplest form, little girls may play with their dolls or little boys with their action figures (or vice versa) in an interactive way.

In another form of interaction, children may preprogram a toy vehicle to move quickly or slowly, or to turn. This utilization by a toy of the child's input is a charming and exciting feature in toys. It is also particularly beneficial in stimulating the early development of children to function more than merely passively in their interactions with their environment.

The phenomenon of singing along with a familiar tune is of course well known. There have been toy-microphone devices that allow the child to speak or sing into a microphone and hear their voices amplified, or presented at a remote location. We are all familiar with being able to pick or select songs or the like from a selection of records, selections on a tape, or simply turning a radio dial.

In all of these instances, the involvement or interaction of a child user with the toy or other apparatus is relatively limited. It is more a question of selection and then sitting back and having the toy do the rest—or, at most, continued participation that is extenal to the toy, in the sense that the child can sing along or do play action on her or his own, but without any real interaction with the activity of the toy itself.

SUMMARY OF THE DISCLOSURE

The present invention contemplates a electronic verbal sound toy that allows the child user to interject a selection repetitively. The child thereby changes the nature of a song, poem or the like that is presented by the device.

The song, poem, etc. starts, and as it progresses the child can preselect or select individual portions, or sets of portions, for insertion. This ongoing or continuing interaction between the child user and the device is fascinating and—especially to young children—somewhat magical; and tends to keep their interest and excitement about the toy.

The invention has two major aspects. Although preferably these are both used together, to produce a toy that provides full enjoyment of all the potentialities of the invention, the major aspects can be used independently if desired.

In the first of these aspects, the invention is an electronic singing or poetry-reciting toy for children. It includes primary memory means for storing information representing vocal rendition of a song or poem that has at least one position reserved for a selectable vocal segment.

In its first aspect the invention also has multiple secondary memory means for storing information representing, respectively, a multiplicity of preestablished selectable vocal segments for insertion into the song or poem at the reserved position; each selectable segment being correct for insertion into the song or poem at the reserved position.

Also included are first control means actuable by a child to initiate electronic vocal rendition of the song or poem, and second control means actuable by a child for choosing a particular selectable segment.

Still in its first aspect, the invention further includes first information-identifying means for responding to the first control means by identifying information from the primary memory means, corresponding to the sounds of the song or poem, for extraction from the primary memory means. Also included are second information-identifying means for responding to the second control means by identifying information from the secondary memory means, corresponding to the sounds of a particular selectable segment chosen, for extraction from the second memory means.

The first aspect of the invention also includes signal-developing means, which perform two functions: (1) extracting information identified by the first and second information-identifying means from the primary and secondary memory means respectively; and (2) developing therefrom electrical signals corresponding to the sounds of the song or poem with the sounds of a particular chosen selectable segment at said position.

Finally the first aspect of the invention includes tone-sounding means for receiving the electrical signals and for responding thereto by sounding said song or poem with a chosen selectable segment inserted thereinto at the reserved position to amuse children.

The foregoing may represent a description of the first aspect of the invention in its broadest or most general form. As will be appreciated, however, it is preferred to practice the invention together with certain additional features, elements or characteristics (as well as the other two major aspects, to be described shortly) to maximize enjoyment of the benefits of the invention.

For example it is preferable that, in the singing or poetry-reciting toy, each selectable segment comprises sounds alluding to a children's song-or-poem character, or to an animal, object, material, place, direction, time, activity or condition.

It is also preferable that the second control means comprise a multiplicity of manually actuable switches, one for selecting each of the multiplicity of selectable segments, respectively. It is further preferable that the toy comprise a corresponding multiplicity of indicia associated with the switches, respectively.

It is also preferred that the reserved position correspond to a point in the song or poem at which allusion is made to a character, animal, object, material, place, direction, time, activity or condition is identified; and that each selectable segment comprise sounds alluding to a character, animal, object, material, place, direction, time, activity or condition.

The indicia serve to identify the corresponding selectable segments selected by said switches, respectively. The indicia preferably represent each said character, animal, object, material, place, direction, time, activity or condition either pictorially or by letters forming words.

Allusion can be made in a great variety of forms, as for example by using a generic or descriptive word that identifies the entity or other concept directly. Another form of allusion within the scope of the invention is suggestive language or other sounds—such as, in particular, a sound emitted by the entity, or in the course of an activity, or in response to a condition, etc.

It is also preferable that the song or poem have not just one but a plurality of reserved positions; and that, correspondingly, the secondary memory means comprise means for storing information for a multiplicity of sets of logically interrelated selectable segments, each set consisting of a plurality of selectable segments for insertion at said reserved positions respectively.

It is accordingly preferable that the second control means when actuated operate to choose an entire set of the logically interrelated selectable segments; and that the second information-identifying means comprise means for identifying information from the secondary memory means that corresponds to the sounds of the selectable-segment set chosen.

As will now be understood, it is also preferred, in conjunction with the plural-position feature discussed in the preceding two paragraphs, that the signal-developing means comprise means for extracting information identified by the first and second information-identifying means—and for developing therefrom electrical signals corresponding to the sounds of the song or poem with all the selectable segments of the chosen set inserted thereinto at their reserved positions, respectively.

In this case the the tone-sounding means respond by sounding the song or poem with all the selectable segments of the chosen set inserted at their reserved positions, respectively. It is preferred that the reserved positions correspond to (1) at least one point in the song or poem at which allusion in one form is made to a character, animal, object, material, place, direction, time, activity or condition, and (2) at least one other point in the song or poem at which allusion in another form is made to a character, animal, object, material, place, direction, time, activity or condition.

It is preferred that each variable-segment set comprise (1) at least one variable segment including sounds alluding in that "one form" to a particular character, animal, object, material, place, direction, time, activity or condition, and (2) at least one variable segment including sounds alluding in said "other form" to the same particular character, animal, object, material, material, place, direction, time, activity or condition.

Thus preferably the first form of allusion comprises a generic or descriptive term for a particular character, animal, object, or material; and the second form of allusion comprises a representation of a sound emitted by the same particular character, animal, object, or material.

In a second major aspect of the invention, not necessarily used in devices that sing songs or recite poetry, the invention is an electronic vocal toy for children. It includes primary memory means for storing information representing a vocal sequence for multiple repetitions. The sequence has a position reserved for insertion of selectable vocal segments cumulatively—which is to say, with repetition of each selectable segment that has been previously introduced.

The second aspect also includes first control means actuable by a child to initiate multiple repetitions of electronic rendition of the vocal sequence; and first information-identifying means for responding to the first control means. The first information-identifying means respond by identifying information in the primary memory means for extraction therefrom in multiple repetitions in substantially direct succession.

In this aspect, the invention also includes multiple secondary memory means for storing information representing, respectively, a multiplicity of preestablished selectable vocal segments for insertion into the vocal sequence. Also included are second control means actuable by a child multiple times for initially choosing a particular segment to be introduced in each of said repetitions, respectively.

This aspect of the invention also includes second information-identifying means for responding to the second control means by identifying information from the secondary memory means. The latter information corresponds to the sounds of a particular segment chosen.

This second aspect of the invention further includes signal-developing means for repetitively, multiple times in substantially direct succession, extracting information identified by the first and second information-identifying means from the primary and secondary memory means respectively. The signal-developing means are also for developing from that information electrical signals corresponding to the sounds of the vocal sequence with the selectable segments inserted thereinto, cumulatively—and also in the same order as first introduced.

Finally, this aspect of the invention includes tone-sounding means for receiving the electrical signals and for responding thereto by sounding said vocal sequence with the selectable segments inserted thereinto at the reserved position, cumulatively and in the same order as first introduced.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
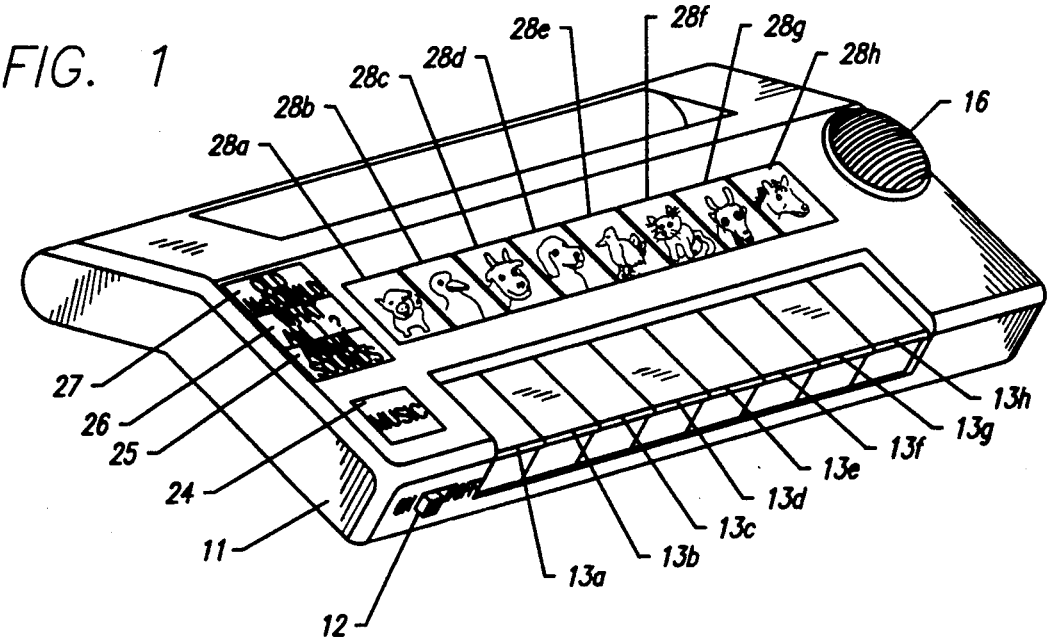
FIG. 1 is a perspective drawing of the exterior of a preferred embodiment of the invention.
Figure 2:
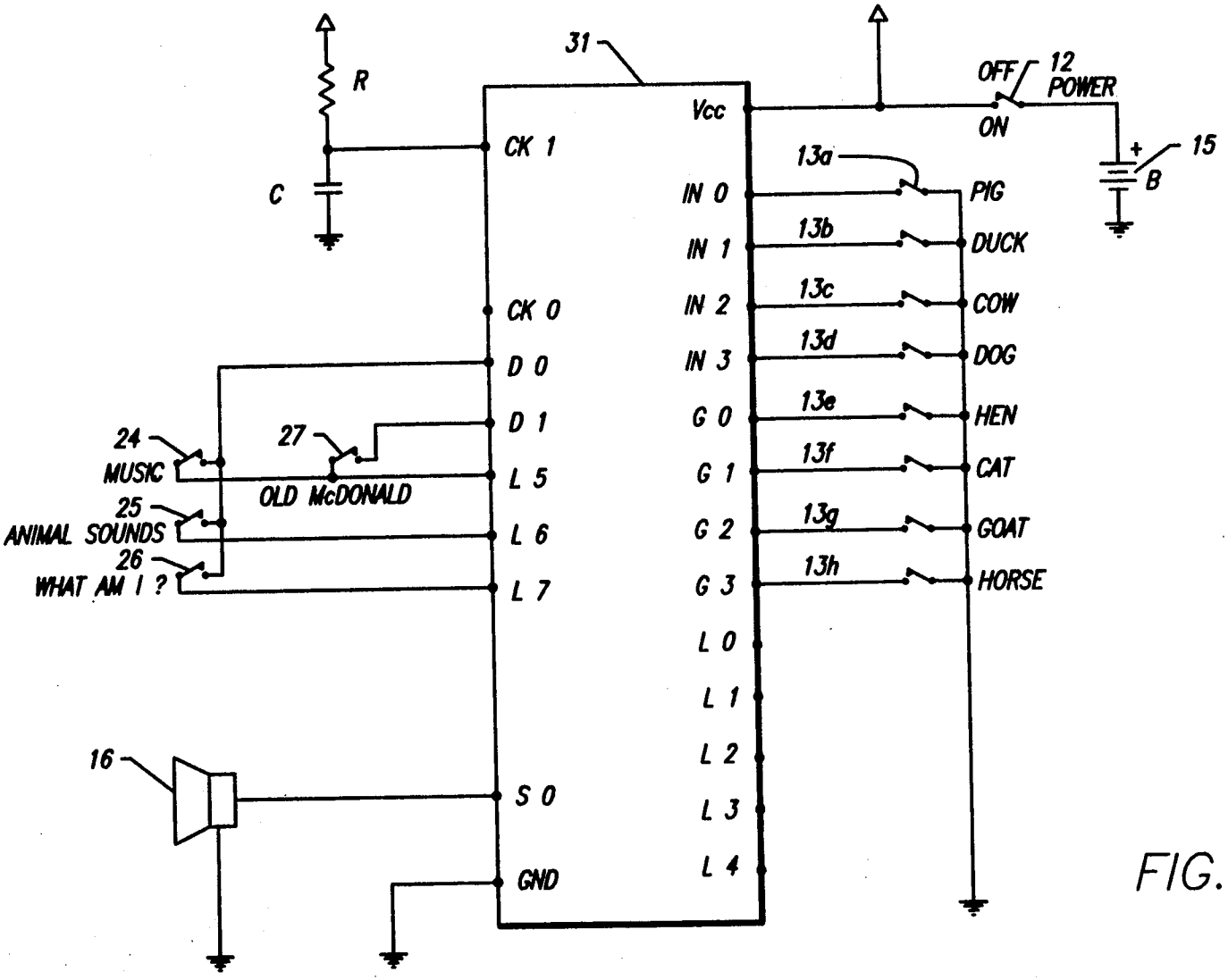
FIG. 2 is an electronic schematic of the same embodiment.

As shown in FIGS. 1 and 2, the preferred embodiment of my instrument has a chassis 11 with a power switch 12 and a keyboard 13. This keyboard consists of eight keys, identified respectively in FIGS. 1 and 2 as keys 13*a* through 13*h*.

Above these are four mode-selection buttons 24 through 27, respectively labelled "Music", "Animal sounds", "What am I?", and "Old McDonald".

A child can use the eight keys on the invention in generally the same way as the white keys in a one-octave range on a normal piano keyboard. Unlike those of other electronic pianos or organs, however, these keys can also be used by a child to produce or respond to acoustic representations of the sounds of certain animals.

For the latter purposes, indicia 28*a* through 28*h* are associated with each key respectively. In the illustrated embodiment these indicia represent, either pictorially (as shown) or literally, eight different animals—but as will be understood, other objects, places, etc. with which distinctive sounds are commonly associated can be substituted for animals without departing from the scope of my invention.

In addition the keys can be used to produce a child's poem or song interactively, in the general way already described in the Summary section of this document.

If a child actuates the "Music" mode-selection button 24, the instrument functions as a normal electronic piano or organ: operation of each key plays one note respectively. If the child instead actuates the "Animal sounds" button 25, then operation of each key causes the apparatus to recall and emit electronically synthesized sounds of eight animals respectively.

Preferably the sounds produced in response to operation of each key are representations of sounds emitted by the eight animals represented by the eight indicia 28*a* through 28*h*, respectively. Thus if the "cow" key 13*c* is pressed, the device emits a "mooing" sound representing the sound made by a cow.

If the "What am I?" mode-selection button 26 is actuated instead, then the apparatus automatically enters a repetitive query-and-response mode of operation. In this mode, the apparatus first emits a representation of the sound of an animal; the child responds by pressing a key the child believes corresponds to the animal that would produce that sound.

More specifically, the child responds by pressing a key whose associated indicium the child believes represents the animal that would produce the emitted sound. If the response is correct—that is, if the key pressed does in fact have an associated indicium representing the animal that would produce that sound—then the device emits a song of congratulation for correct response.

If not, the device emits sounds so indicating. As will be understood, many other means of indicating whether the response was correct or not can be substituted for synthesized voice means—as, for example, other acoustic means, and optical, mechanical, etc., means—all within the scope of the invention.

The fourth mode-selection button 27 refers to interactive presentation of a song, namely the well-known children's song "Old McDonald Had a Farm". The invention, however, is not limited to use with this one song, and in fact can also be used with poems and other vocal presentations as well as songs.

It is preferable, however, to use a song or poem that has repetitive verses in which relatively short, simple selectable segments are inserted. The song "Old McDonald Had a Farm" is particularly suited for use with the invention in that this song has another interesting characteristic: the insertions are cumulated.

In other words, in each verse a particular animal name and sound is introduced; and then all of the animal sounds that have been introduced in previous verses are repeated, in the same order. As is well-known, in the familiar song under discussion the repetitions of animal sounds previously introduced are actually in reverse order, relative to the order in which they were introduced. For purposes of this document, in the interest of simplifying the language of the appended claims and this description, the phrase "same order" is hereby defined to mean either the same order or the reverse order.

In operation, when the "Old McDonald" mode-selection button 27 has been actuated, the device begins to repeat an electronically synthesized rendition of the song. At each point where the name of an animal is to be inserted—vis., "And on that farm there was a"—the device checks to see whether one of the keys has been pressed to indicate a selection.

If not, the device waits for a period of time, and if there is no response, shuts itself off. If a key is pressed either before or during the waiting period, the device proceeds with rendition of the song, using the designated animal name after the phase just quoted. Thus if the "cow" key 13*c* is pressed, the song will sound " . . . there was a cow"; and then proceed.

Furthermore, when the later point in the song, "With a . . . here and a . . . there; here a . . . , there a . . . , everywhere a . . . ", is reached, the device will insert into the song at each ellipsis the singing of a mooing sound representing a cow's lowing. In the first verse, the verse will then end and the second verse begin.

In the second and subsequent verses, however, the device will repeat "With a . . . here and a . . . there; here a . . . , there a . . . , everywhere a . . . ", but inserting the sound of each animal introduced in a previous verse—working its way backward through the recitation of sounds of introduced animals until it reaches the animal introduced in the first verse.

As can now be seen, the device actually makes insertions that may be described as having these several different characteristics:

(1) insertion of a word (in this case generic) representing an animal chosen by the child user of the device;
(2) insertion of a sound associated with the animal chosen, and in fact representative of a sound that the animal makes;
(3) insertion of a set of sounds that are logically related to each other—e.g., here preferably a word representing an animal, and a sound made by the same animal; and
(4) insertion of sounds cumulatively, in the same order (as above defined).

It may now be appreciated that any of these different characteristics may be employed independently of the others. That is to say, for example, the device need not necessarily use a word representing an animal (or other entity, etc.), or in fact any word at all—but may nevertheless use characteristics (2) through (4).

Similarly the device need not necessarily employ sounds made by the animal; and theoretically need not insert, in each verse, sounds that are related to each other logically. Also, in each verse the device need not emit sounds cumulatively.

It will also be appreciated that the references need not be to animals at all, but may equally well be to children's song-or-poem character, or to an object, material, place, direction, time, activity or condition. Thus for example, one old folk song for children represents a child asking several different friends and relatives to help the child bathe and prepare clothing, in successive verses reciting—

"Mommy, oh Mommy, come scrub my back,"
"Brother, oh brother, come polish my shoe,"
"Granny, oh granny, come clean my neck,"
"Shanie, oh Shanie, come wash my feet,"—etc.

As can be seen from these verses, the several variables introduced in each verse are not necessarily interrelated logically. Thus, for instance, any of the characters might be invoked in connection with any of the several activities involved, though some may seem more logical than others; and some (but not all) of the verbs are interchangeable.

Any such reference points (objects, directions, children's song-or-poem characters, etc.) can be used with any of the four characteristics enumerated above. Hence a very large number of implementations of my invention are possible.

FIG. 2 shows how a microprocessor 31 is connected to a power switch 12 and source 15, mode-selection buttons 24–27, and keyboard 13; and also to a sound-emitting electromechanical transducer 16. "Microprocessor" as used herein is defined as a microprocessor system comprising a microcontroller and memory. The microprocessor 31 may be of the type commercially available from the National Semiconductor Corporation under the component designator "COPS-420L" with additional memory.

The switches may be of nearly any commercial type, or custom-made printed-circuit switch pads. The keys need not be of the same quality as conventional synthesizer key-switches, as the invention is essentially a toy; they may be less expensive switches such as are customarily used for toy keyboards.

The electrical components in the circuit may be selected as follows. The battery B may be a nine-volt battery. The resistor R may be sixty-eight kilohms and the capacitor C may be sixty-eight picofarads.

The resistor R and capacitor C together form an R-C oscillator to establish the clock frequency of the microprocessor. As is well-known to those skilled in the art of digital microprocessor-circuit design, more accurate and stable tone frequencies may be provided by substituting a clock crystal and suitable biasing components for the R-C oscillator illustrated.

Figure 3:
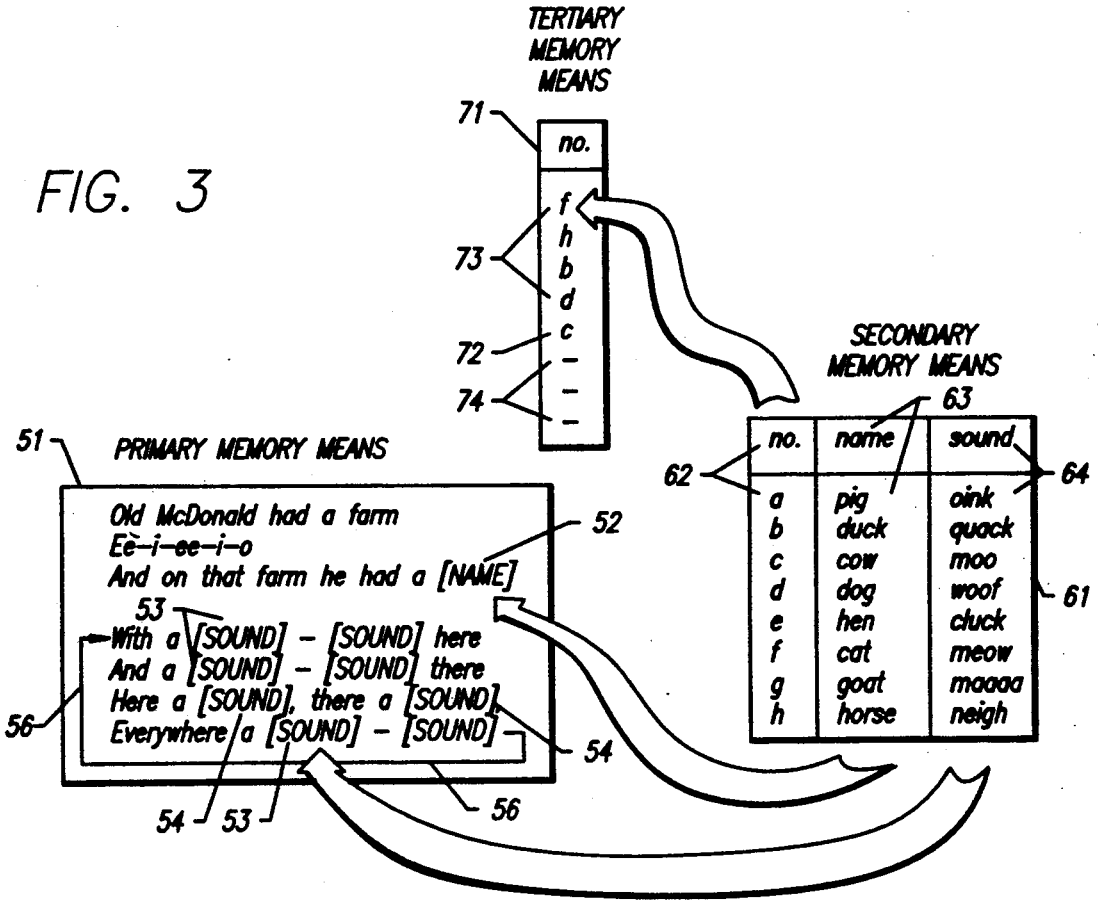
FIG. 3 is a diagram showing internal organization of some of the memory means in the same embodiment, together with usage of the information stored in the memory means in operation of the embodiment.

As shown in FIG. 3, the primary memory means may be organized as a single unitary lookup table 51 with information representing the sounds of the basic song, poem, or other vocal presentation. Insertion points 52–54 can be designated in this table 51, or stored elsewhere as the number of clock pulses between insertions, or identified in various other known ways.

The secondary memory means are also a lookup table 61, but structured in a manner akin to a database. Each record a through h consists of a set of fields 62–64 having various sound-representing information modules for introduction in a single verse, and all of the fields in each record possibly being related logically.

It will be understood that the various fields 62–64 in each record a–h may be arbitrary instead—that is, not logically related to each other. (Yet another alternative is to use independent lists of selectable modules for each insertion point, so that the several insertions in each verse are related to one another randomly, or by choice of the child using the device.)

The specific animal sounds may be handled in various ways. For instance, in the song "Old McDonald Had a Farm", all the animal sounds are usually sung in a monotone, or in any event at substantially the same pitch, so that it is not necessary to provide different versions of the sounds for insertion at different places.

At three places 53 in the song, the animal sound is recited twice in immediate succession (as, for example, "moo moo"), and in two places 54 the sound is recited once in isolation (as just "moo"). Because of the traditional monotone character of that part of the song, however, it is feasible to simply record information corresponding to one "moo" sound, in the second memory means, and insert that information twice in succession where appropriate.

In other songs or poems, different pitch, harmony or inflection may be required for a particular word or sound as recited at different points. In such cases it may be necessary to treat those different versions of a single sound as separate selectable vocal segments.

The tertiary memory means are more in the nature of a push-down pointer table with variable data. Its contents identify the records of the secondary memory means that have been chosen by the child user in previous cycles through the contents of the primary memory means.

The tertiary memory means are for use in cumulative presentation of the contents of the previously chosen records of the secondary memory means. Thus if the first key pressed is 13*c*, to choose the selectable vocal segments "cow" and "moo", then the record identification character "c" is stored in the top position of the tertiary memory means 71, leaving—for example—seven unfilled lower positions in the tertiary memory means.

If the next four keys pressed in sequence are 13*d*, 13*b*, 13*h* and 13*f*—to choose "dog" and "woof", "duck" and "quack", "horse" and "neigh", and "cat" and "meow" respectively—then the corresponding record identification characters "d", "b", "h" and "f" are each in succession entered into the top position of the tertiary memory means. As each is entered, all the preceding entries are moved down one position in the table, so that after all five entries have been made the first entry "c" is at the fifth position 72, leaving the three bottom positions 74 still unfilled.

In retrieval of information from the primary memory means 51, in the first pass through the information in the primary memory means the word "cow" is inserted in the first reserved position 52, and the sound "moo" is inserted twice into each of the double-recitation reserved positions 53, and once into the single-recitation positions 54. The verse ends essentially at that point, or with an extra recitation of the top two lines in the illustration.

In subsequent passes through the information in the primary memory means, the bottom four lines in the primary memory means are sounded repetitively as suggested by the arrow 56. At each repetition point, the microprocessor refers to the next entry in the tertiary memory means to determine whether another repetition should in fact occur, and if so which record of the secondary memory means should be used in selecting insert segments for that repetition. When the microprocessor reaches the first of the unfilled positions 74 in the tertiary memory means, or the end of that table—whichever occurs first—the minor loop 56 is broken and pointer returns to the top of the primary memory means table 51 to begin another verse.

Thus, while the loop 56 is shown for convenience of illustration as associated with the primary memory means 51, in actuality the loop will generally be controlled by the tertiary memory means. In embodiments that do not use cumulative replay, the tertiary memory means (and associated programming functions) are omitted.

Figure 4:
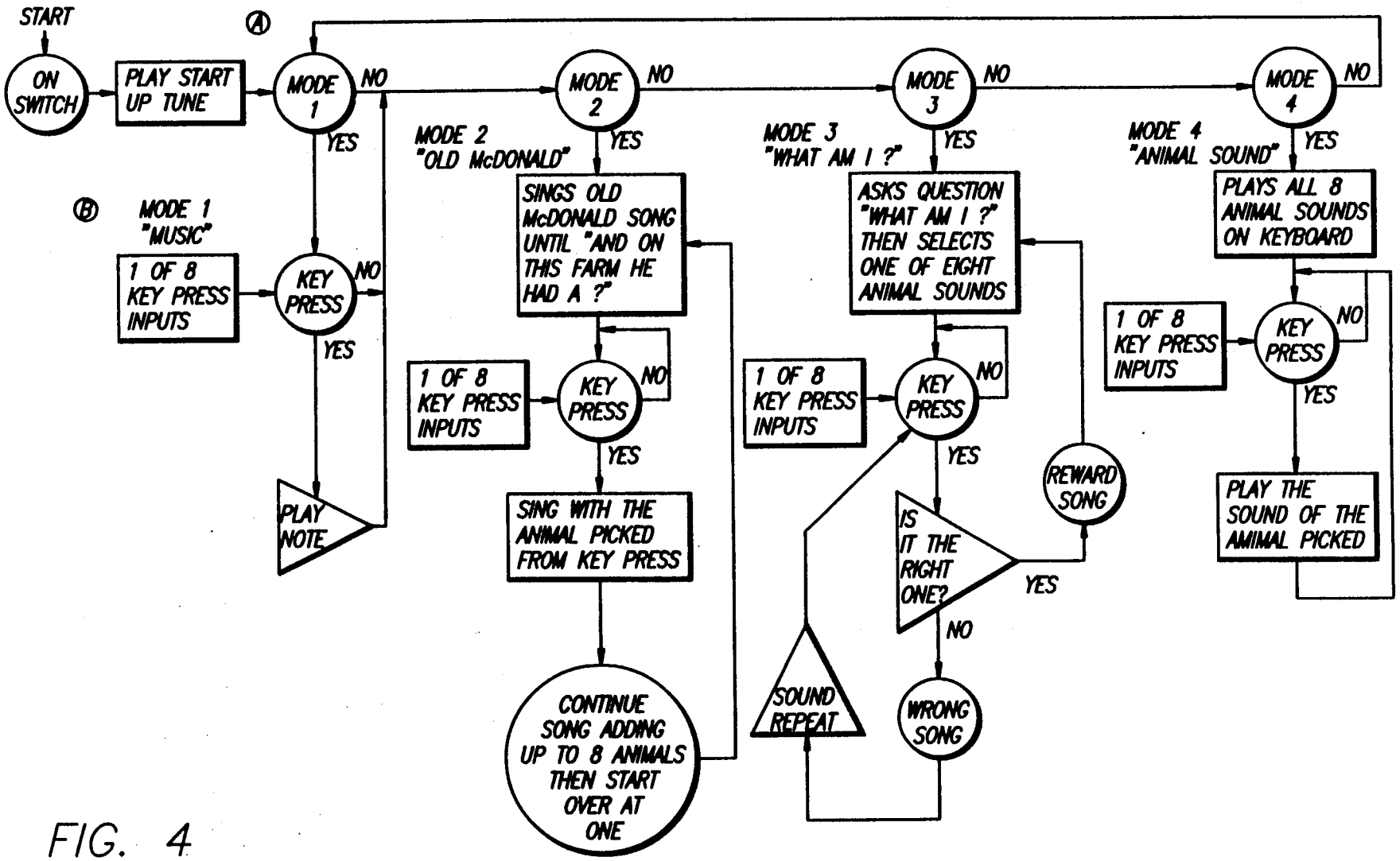
FIG. 4 is a flow chart showing operation of firmware in a microprocessor used in the embodiment.

FIG. 4 shows how the microprocessor may be programmed to produce the behavior that has been described. For those skilled in the art of programming microprocessors of the type stated above, this diagram will be found self explanatory.

As the tertiary memory means has a finite capacity, the number of cumulatively presented selectable segments must be limited. For most small children it will be hard to remember more than five or ten animal names or the like in sequence; and generally speaking a song becomes somewhat less interesting if any of the animal names—that is to say, any of the records in the database—is chosen more than once per complete song.

Accordingly it is considered preferable to make the number of memory positions in the tertiary memory means equal to the number of keys 13*a–h*. For the embodiment described, that number is eight. As will be understood, the song may be allowed to go on repeating as long as the child wishes to participate, but the number of cumulating repititions is cut off at eight by dropping earlier—introduced animal names.

It will be understood that the foregoing disclosure is intended to be merely exemplary, and not to limit the scope of the invention—which is to be determined by reference to the appended claims.

I claim:

1. An electronic singing or poetry-reciting toy for children, said toy comprising:

primary memory means for storing information representing vocal rendition of a song or poem that has at least one position reserved for a selectable vocal segment;

multiple secondary memory means for storing information representing, respectively, a multiplicity of preestablished selectable vocal segments for insertion into the song or poem at the reserved position; each selectable segment being correct for insertion into the song or poem at the reserved position;

first control means actuable by a child to initiate electronic vocal rendition of the song or poem;

second control means actuable by a child for choosing a particular selectable segment;

first information-identifying means for responding to the first control means by identifying information from the primary memory means, corresponding to the sounds of the song or poem, for extraction from the primary memory means;

second information-identifying means for responding to the second control means by identifying information from the secondary memory means, corresponding to the sounds of a particular selectable segment chosen, for extraction from the second memory means;

signal-developing means for extracting information identified by the first and second information-identifying means from the primary and secondary memory means respectively and for developing therefrom electrical signals corresponding to the sounds of the song or poem with the sounds of a particular chosen selectable segment at said position;

tone-sounding means for receiving the electrical signals and for responding thereto by sounding said song or poem with a chosen selectable segment inserted thereinto at the reserved position to amuse children.

2. The singing or poetry-reciting toy of claim 1, wherein:

each selectable segment comprises sounds alluding to a children's song-or-poem character, or to an animal, object, material, place, direction, time, activity or condition.

3. The singing or poetry-reciting toy of claim 1, wherein:

the song or poem has a plurality of reserved positions;

the secondary memory means comprise means for storing information for a multiplicity of sets of logically interrelated selectable segments, each set consisting of a plurality of selectable segments for insertion at said reserved positions respectively;

the second control means when actuated operate to choose an entire set of said logically interrelated selectable segments; and the second information-identifying means comprise means for identifying information from the secondary memory means that corresponds to the sounds of the selectable-segment set chosen; and the signal-developing means comprise means for extracting information identified by the first and second information-identifying means and for developing therefrom electrical signals corresponding to the sounds of the song or poem with all the selectable segments of the chosen set inserted thereinto at their reserved positions, respectively; and the tone-sounding means respond by sounding said song or poem with all the selectable segments of the chosen set inserted thereinto at their reserved positions, respectively.

4. The toy of claim 3, wherein:

the reserved positions correspond to (1) at least one point in the song or poem at which allusion in one form is made to a character, animal, object, material, place, direction, time, activity or condition, and (2) at least one other point in the song or poem at which allusion in another form is made to a character, animal, object, material, place, direction, time, activity or condition; and each variable-segment set comprises (1) at least one variable segment including sounds alluding in said one form to particular character, animal, object, material, place, direction, time, activity or condition, and (2) at least one variable segment including sounds alluding in said other form to the same particular character, animal, object, material, material, place, direction, time, activity or condition.

5. The toy of claim 4, wherein:

the first form of allusion comprises a generic or descriptive term for a particular character, animal, object, or material; and the second form of allusion comprises a representation of a sound emitted by the same particular character, animal, object, or material.

6. The toy of claim 1:

wherein the second control means comprise a multiplicity of manually actuable switches, one for selecting each of the multiplicity of selectable segments, respectively; and further comprising a corresponding multiplicity of indicia associated with said switches, respectively; and identifying the corresponding selectable segments selected by said switches, respectively.

7. The toy of claim 6, wherein:

the reserved position corresponds to a point in the song or poem at which allusion is made to a character, animal, object, material, place, direction, time, activity or condition is identified; and each selectable segment comprises sounds alluding to a character, animal, object, material, place, direction, time, activity or condition.

8. The toy of claim 7, wherein:

the indicia represent each said character, animal, object, material, place, direction, time, activity or condition pictorially.

9. The toy of claim 7, wherein:

the indicia represent each said character, animal, object, material, place, direction, time, activity or condition by letters forming words.

10. The toy of claim 1:

wherein the second control means comprise a switch manually actuable in a multiplicity of selectable positions, one position for selecting each of the multiplicity of selectable segments, respectively; and further comprising a corresponding multiplicity of indicia associated with said multiplicity of switch positions, respectively; and identifying the corresponding selectable segments selected by actuating the switch in those positions, respectively.

11. An electronic vocal toy for children, said toy comprising:

primary memory means for storing information representing a vocal sequence for multiple repetitions, said sequence having a position reserved for insertion of selectable vocal segments cumulatively;

first control means actuable by a child to initiate multiple repetitions of electronic rendition of the vocal sequence;

first information-identifying means for responding to the first control means by identifying information in the primary memory means for extraction therefrom in multiple repetitions in substantially direct succession;

multiple secondary memory means for storing information representing, respectively, a multiplicity of preestablished selectable vocal segments for insertion into the vocal sequence;

second control means actuable by a child multiple times for initially choosing a particular segment to be introduced in each of said repetitions, respectively;

second information-identifying means for responding to the second control means by identifying information from the secondary memory means, corresponding to the sounds of a particular segment chosen; and signal-developing means for repetitively, multiple times in substantially direct succession, extracting information indentified by the first and second information-identifying means from the primary and secondary memory means respectively and for developing therefrom electrical signals corresponding to the sounds of the vocal sequence with the selectable segments inserted thereinto cumulatively, in the same order as initially chosen; and tone-sounding means for receiving the electrical signals and for responding thereto by sounding said vocal sequence with the selectable segments inserted thereinto at the reserved position cumulatively, in said order.

12. An electronic vocal toy for children, said toy comprising:

primary memory means for storing information representing a vocal sequence for repetition multiple times in substantially direct succession, said sequence having a position reserved for cumulative presentation, in each repetition, of selectable vocal segments;

first control means actuable by a child to initiate multiple repetitions of electronic rendition of the vocal sequence;

first information-identifying means for responding to the first control means by identifying information from the primary memory means, corresponding to the sounds of the sequence, for extraction from the primary memory means; and for thereafter repetitively identifying information from the primary memory means for extraction multiple times in substantially direct succession;

multiple secondary memory means for storing information representing, respectively, a multiplicity of preestablished selectable vocal segments for insertion into the vocal sequence at the reserved position;

second control means actuable by a child multiple times for arbitrarily choosing a particular one of said selectable segments to be used in each of said repetitions, respectively;

tertiary memory means for storing information representing the segment choices made by a child, in the order in which the child chooses the segments;

second information-identifying means for responding to the second control means by:

identifying information from the secondary memory means, corresponding to the sounds of a particular selectable segment chosen, for extraction from the second memory means and insertion into a particular repetition of the information from the primary means; and subsequently recalling information corresponding to the sounds of said segment for reextraction and reinsertion into subsequent repetitions of the information from the primary memory means;

third information-identifying means for recalling from the third memory means the selectable-segment choices made by a child, in the order in which the child chooses the segments, and for responding to said recalled choices by placing said segments in that same order in all said subsequent repetitions; said reextraction and reinsertion of each segment being in conjunction with reextraction and reinsertion of other selectable segments, cumulatively, in the same order as initially extracted and inserted;

signal-developing means for repetitively, multiple times in substantially direct succession, extracting information identified by the first, second and third information-identifying means from the primary, secondary and tertiary memory means respectively and for developing therefrom electrical signals corresponding to the sounds of the vocal sequence with the selectable segments inserted thereinto;

said electrical signals including signals corresponding to the sounds of reextracted and reinserted segments from plural segments in conjunction with one another, cumulatively, in the same order as said signals are initially developed; and tone-sounding means for receiving the electrical signals and for responding thereto by sounding said vocal sequence with the selectable segments inserted thereinto at the reserved position;

said tone-sounding means sounding said reextracted and reinserted segments in conjunction with one another cumulatively, in the same order as initially sounded.

13. The toy of claim 12, wherein:

the vocal sequence comprises a song or poem;

the reserved positions correspond to (1) at least one point in the song or poem at which allusion in one form is made to a character, animal, object, material, place, direction, time, activity or condition, and (2) at least one other point in the song or poem at which allusion in another form is made to a character, animal, object, material, place, direction, time, activity or condition; and each selectable segment comprises (1) sounds alluding in said one form to particular character, animal, object, material, place, direction, time, activity or condition, and (2) sounds alluding in said other form to the same particular character, animal, object, material, material, place, direction, time, activity or condition.

14. An electronic vocal toy for children, said toy comprising:

primary memory means for storing information representing a vocal sequence for repetition multiple times in substantially direct succession, said sequence having a plurality of sequential positions reserved for a corresponding plurality of selectable vocal segments; at least one of said reserved positions being for cumulative presentation, in each repetition, of multiple segments;

multiple secondary memory means for storing information representing, respectively, a multiplicity of sets of preestablished, logically interrelated selectable vocal segments; each set consisting of a plurality of selectable segments for insertion into the sequence at the reserved positions, respectively, and each selectable segment being correct for insertion into the sequence at its corresponding reserved position;

first control means actuable by a child to initiate multiple repetition of electronic rendition of the vocal sequence;

second control means actuable by a child multiple times for choosing a particular one of said sets to be used in each of said repetitions, respectively;

tertiary memory means for storing information representing the set choices made by a child, in the order in which the child chooses the sets;

first information-identifying means for responding to the first control means by identifying information from the primary memory means, corresponding to the sounds of the vocal sequence, for extraction from the primary memory means; and for thereafter repetitively identifying information from the primary memory means for extraction multiple times in substantially direct succession;

second information-identifying means for responding to the second control means by identifying information from the secondary memory means, corresponding to the sounds of a particular selectable-segment set chosen, for extraction from the second memory means and insertion into a particular repetition of the information from the primary means; and also for subsequently recalling sounds of at least a single segment of said set for reextraction and reinsertion into subsequent repetitions of the information from the primary memory means;

third information-identifying means for recalling from the tertiary memory means the set choices made by a child, in the order in which the child chooses the sets, to place said single segments of said sets in that same order in all said subsequent repetitions; said reextraction and reinsertion of one segment from a set being in conjunction, cumulatively, with extraction and insertion of corresponding segments of other sets, in the same order as said sets are initially extracted and inserted;

signal-developing means for repetitively, multiple times in direct succession, extracting information identified by the first, second and third information-identifying means from the primary, secondary and tertiary memory means respectively and for developing therefrom electrical signals corresponding to the sounds of the vocal sequence with all the selectable segments of a particular chosen set inserted thereinto at their reserved positions, respectively;

said electrical signals including signals corresponding to the sounds of reextracted and reinserted segments from plural sets in conjunction with one another, cumulatively, in the same order as said signals are initially developed; and tone-sounding means for receiving the electrical signals and for responding thereto by sounding said vocal sequence with all the selectable segments of the chosen set inserted thereinto at their reserved positions, respectively;

said tone-sounding means sounding said reextracted and reinserted segments from plural sets in conjunction with one another, cumulatively, in the same order as initially sounded.

* * * * *